US005409054A

United States Patent [19]

Moriceau

[11] Patent Number: 5,409,054

[45] Date of Patent: Apr. 25, 1995

[54] PROCESS AND PLANT FOR AUTOMATIC CASTING OF SEMI-FINISHED PRODUCTS

[75] Inventor: Jacques Moriceau, Voiron, France

[73] Assignees: Aluminum Pechiney; Pechiney Rhenald, both of Coubevoie, France

[21] Appl. No.: 187,129

[22] Filed: Jan. 27, 1994

Related U.S. Application Data

[63] Continuation of Ser. No. 889,411, May 28, 1992, abandoned.

[30] Foreign Application Priority Data

Jun. 7, 1991 [FR] France ..... 91 07608

[51] Int. Cl.[6] ..... B22D 11/18; B22D 11/20

[52] U.S. Cl. ..... 164/453; 164/413; 164/420; 164/454; 164/483; 164/449.1; 164/450.1

[58] Field of Search ..... 164/453, 454, 483, 449, 164/450, 413, 420

[56] References Cited

U.S. PATENT DOCUMENTS

| | | | |
|---|---|---|---|
| 3,946,795 | 3/1976 | Bruderer et al. . | |
| 4,730,660 | 3/1988 | Tinnes et al. . | |
| 4,774,999 | 10/1988 | Kraus | 164/483 X |
| 5,170,839 | 12/1992 | Feuerstacke et al. | 164/453 |
| 5,174,360 | 12/1992 | Barbe | 164/453 |
| 5,174,361 | 12/1992 | Kursfeld | 164/483 X |

FOREIGN PATENT DOCUMENTS

| | | | |
|---|---|---|---|
| 0186116 | 7/1986 | European Pat. Off. . | |
| 56-68570 | 6/1981 | Japan | 164/483 |
| 62-192246 | 8/1987 | Japan | 164/453 |
| 2099189 | 12/1982 | United Kingdom . | |

OTHER PUBLICATIONS

Patent Abstracts of Japan, vol. 12, No. 247 (M-717), Jul. 13, 1988 of JP 63-33153.

*Primary Examiner*—J. Reed Batten, Jr.

*Attorney, Agent, or Firm*—Dennison, Meserole, Pollock & Scheiner

[57] ABSTRACT

In the process, which enables complete automation of casting and limiting the intervention of the operator, the level of metal in the supply runner is monitored, a common law of metal levels is set as a function of time for all ingot molds after individual laws have been applied to each of the molds in order to permit them to meet the common law, lowering of the table supporting the molds is actuated and the casting process is halted when the program length has been obtained. The apparatus comprises probes for detecting the height and levels of metal in the runner and in the ingot molds, and an automation system for adjusting the levels and controlling the various operations.

9 Claims, 10 Drawing Sheets

PROCESS AND PLANT FOR AUTOMATIC CASTING OF SEMI-FINISHED PRODUCTS

This is a continuation of application Ser. No. 07/889,411 filed on May 28, 1992, and now abandoned.

1) TECHNICAL FIELD OF THE INVENTION

The invention which is the subject of the present patent application relates to continuous or semi-continuous vertical casting of semi-finished metal products.

The principle of continuous vertical casting is well known: it consists in casting the molten metal inside a mold formed by the part of the cast metal which has already solidified. A continuous casting plant consists, in its simplest form (FIG. 1), of:

—a casting mold or ingot mold (1) of cylindrical or straight prismatic form according to the shape of the section of the cast product, i.e. billet or plate. This ingot mold has a vertical axis of symmetry and is open at its upper and lower ends;

—a bottom block (2) sealing the lower end at starting-up and thus forming the bottom of a mold whose walls are formed by the ingot mold;

—a cooling system for the ingot mold, formed for example of a sheet of water (3) striking the outer upper part of the ingot mold and trickling along its generatrices and then along the cast product;

—a table (4) supporting the bottom block equipped with means (not shown) permitting the false bottom to be lowered at an adjustable, even speed;

—a runner (5) for supplying molten metal, equipped with one or more nozzles (6) through which the metal runs into the ingot mold;

—a float (7) having the function on the one hand of distributing the metal throughout the section of the product and on the other hand of adjusting the height of the metal in the ingot mold, the plug of the float optionally being equipped with a pin (8) for partly sealing the nozzle when the level is rising.

During starting-up, the table is in the upper position and the bottom block is engaged lightly inside the ingot mold with just sufficient play that the molten metal cannot seep out. The ingot mold is cooled by the sheet of water. The molten metal is poured via the runner (5) and the nozzle (6) into the mold formed by the ingot mold and the bottom block. Solidification starts from the walls of the cooled ingot mold and the bottom block. When a sufficiently hard crust has thus formed, the support table of the bottom blocks is lowered, and casting is continued, the limit of the solid and liquid phases, known as the solid/liquid interface, having in cross-section the approximate shape shown in FIG. 1 at (9).

It is then possible:

—either to continue casting and to stop when the desired length of the cast product is obtained: this is semi-continuous casting, the only method applied to aluminum alloys (but more often known as "continuous casting")

—or to continue casting until the furnace is completely drained, by cutting the cast product to desired consecutive lengths, having optionally curved it to make it horizontal: this is continuous casting in the strict sense, applied to steel.

For the sake of productivity, it is customary, at least in the casting of aluminum products, to cast several products at a time: a plurality of ingot molds are mounted on a casting unit a plurality of bottom blocks on a support table and the runner is equipped with a plurality of nozzles.

Manual starting of a casting operation on such a multiple-outflow casting unit has a number of disadvantages, both as regards the quality of products and the safety of the operator. The ingot molds do not fill up at the same speed, and so because the lowering of the bottom blocks cannot start until the required level of metal is reached in all the ingot molds, the operator is forced to intervene manually to delay the filling of the ingot molds which are more "advanced", so as to bring them all to the starting level at the same time. Obviously this method, which requires great dexterity on the part of the operator, does not ensure good reproducibility of the starting-up conditions and is the source of defects at the feet of the castings, which can result in scrapping of the whole product. Furthermore, it exposes the operator, who is right next to the casting unit, to splashes of molten metal, to explosive metal-water reactions which are more frequent in the interim conditions of starting-up.

2) PROBLEM POSED

The problem which the Applicant has posed is complete automation of semi-continuous casting, such that the operator can be moved away from direct proximity to the casting unit and only intervenes to indicate the casting parameters: the nature of the alloy, the shape, dimensions and number of products cast simultaneously, and in order to start the casting operation by a command given to the automation system. This system piloting the casting operation therefore comprises a data base containing the casting conditions according to the alloys and formats and their possible progression in the course of time.

3) DESCRIPTION OF THE PRIOR ART

The British Patent 1449846 (CONCAST), published on 15 Sep. 1976 discloses a process for regulating the flow of metal into a continuous casting plant, consisting in:

—measuring the level of metal in the mold,

—supplying a signal representing this level,

—generating a reference signal representing the desired level of metal,

—comparing the signal representing the level with the reference signal,

—generating an output signal to act either on the flow of metal or on the speed of lowering of the cast product.

The teaching of this patent does not provide a solution to two problems, namely the problem of regulating continuous casting with a plurality of outflows and the problem of the interim conditions of filling the ingot molds at start-up.

The U.S. Pat. Nos. 4,498,521 and 4,567,935 (KAISER ALUMINUM & CHEMICAL) disclose respectively a process and apparatus for automatic casting. The process solves the two above-mentioned problems, because it involves a process for regulating the level of the metal in a vertical continuous casting plant with a plurality of outflows during start-up, so that it is possible to bring the levels of metal in the different ingot molds into the same horizontal plane before lowering the table.

However, this process does not make the whole casting operation automatic, because it does not take into account the tilting of the furnace. Furthermore, as will be explained below, the level laws of the individual ingot molds are substantially parallel, i.e. they join the common law of levels at different points. In the present invention, each individual ingot mold has its own law of catching up with the common law, this individual law sloping more or less according to the delay of the level in the ingot mold in question and being so adapted that the common law of levels is reached at the same instant.

The U.S. Pat. No. 4,660,586 (ALUMINUM COMPANY OF AMERICA) claims a process for regulating the level of a molten metal cast into a receptacle. This process comprises the following stages:

—detection of the level of molten metal,

—comparison of the level detected with a reference level in order to determine the difference, —variation of the flow of molten metal by means of a stepper motor, the steps of the movement of the motor being the sum of a term proportional to the difference, a term proportional to the derivative of the difference, and a term proportional to the second derivative of the difference.

The teaching of this patent is entirely general: it can be applied to the level control of any liquid in any receptacle and in particular to the level control of a metal in an ingot mold. But it does not permit the automatic execution of all the successive phases between the starting-up and continuation of a continuous casting operation.

4) ACCOUNT OF THE INVENTION

The invention relates to a process and apparatus for total automation of the successive phases taking place in the starting-up and continuation of continuous casting of plates or billets composed of a metal alloy, and in particular an aluminum alloy, with a plurality of outflows.

Two fundamental principles governed the conception of the invention:

—to set the most simultaneous filling sequences possible of all the ingot molds, in order that this phase be carried out in the same conditions for all outflows and that starting of lowering of the panel take place at a level of molten metal which is close, predetermined and reproducible in all ingot molds;

—to avoid having to halt the supply of molten metal into an ingot mold altogether, since complete halting leads to cold folds on the feet of the products, which are a source of cracks.

The process is characterised in that it comprises a preliminary phase and five main consecutive phases. The operator starts the first preliminary phase, then the first main phase. The subsequent phases follow on automatically, and are:

1) A preliminary phase of determining the point of closure and pre-positioning of the stopper rods, a type of pin (to be described below) for regulating the flow into each ingot mold.
2) A metal supply phase by the casting furnace.
3) A phase of forced supply of the ingot molds.
4) An individual "catching-up" phase of the level of metal in each ingot mold, during which the ingot molds are brought to a common set level.
5) A phase of following a common level law in all ingot molds.
6) A phase of lowering of the panel, following a level law as a function of the length cast.

Each phase comprises itself a certain number of consecutive stages, which are described below:

4.1 Preliminary phase of determining the point of closure and pre-positioning of the stopper rods This phase is initiated on demand by the operator before the start of casting.

The system first carries out an automatic sequence of searching for the point of closure of each of the stopper rods. This is an indispensable preliminary to the next stage, which is the pre-positioning of the stopper rods before casting, and to the casting stages proper, where positionings at clearly defined apertures will also be set.

In general, the pre-positioning of the stopper rods is effected at zero aperture. In a modification of the process, described below in more detail, this pre-positioning is effected at an aperture other than zero, and optionally at a different aperture for each outflow.

4.2 Metal supply phase by the casting furnace

This phase is initiated on demand by the operator, and provided that phase 4.1 has been favourably concluded. It is the first of the phases of automatic casting, from which the subsequent phases follow on without further intervention by the operator.

During this phase, the following stages are carried out:

a) tilting of the furnace for supplying molten metal if it is of the tilting type, or opening of the stopper sealing the casting hole if the furnace is fixed;
b) filling of the runner supplying the ingot molds. In general, the nozzles located at the lower part of the runner above each ingot mold are closed by stopper rods, so that the metal fills the runner without running into the ingot molds. In particular, where the nozzles are not closed by stopper rods, a dam is located just upstream of the nozzle supplied first, likewise so that the metal fills the runner without running into the ingot molds.

This phase ends when the level of molten metal in the runner has reached a predetermined value.

4.3 Phase of forced supply

This phase begins when the level of molten metal in the runner has reached a predetermined value or threshold level and ends for each ingot mold when the level sensor (which will be described below) senses a certain height dh of metal on the bottom block. The end of this phase, and therefore its duration, vary with the ingot molds.

When the threshold level is reached in the runner, the following stages are triggered:

c) at this moment $T_0$, when the threshold level of molten metal in the runner is reached, positioning of the stopper rods supplying the ingot molds at an aperture known as the initial aperture and releasing of the origin of times of a law of variation of the metal level N as a function of time, which will take effect slightly later, and which will be common to all ingot molds: $N=f(T)$.

This stage can be modified as follows: at the moment $T_0$ when the level of molten metal in the runner reaches a predetermined value, opening of the stopper rods supplying the ingot molds to a rather wide aperture in order to have a high metal flux which avoids solidification, releasing of the origin of times of the prospective law of variation of the metal level common to all ingot molds, then partial closure of the stopper rods as far as the position of said initial aperture.

In a particular case where the preceding phase has taken place with the stopper rods open, and where the metal has been contained by a dam, the progress of the stage is as follows: opening of the dam located just upstream of the first nozzle and release of the origin of the time $T_0$ of the prospective law of variation of the metal level $N=f(T)$.

In this particular case, the preceding modification may also be used. The pre-positioning of the stopper rods is then effected in a position of over-aperture, and partial reclosing to the position known as the initial aperture takes place slightly after opening of the dam.

d) maintenance of a constant level in the runner by means for sensing this level and by a control system acting on the tilting or aperture of the stopper rod of the holding furnace;

e) when any one of the molten metal level sensors installed above each ingot mold senses a specified metal height above the bottom block dh, the forced supply phase gives way to the catching-up phase for that ingot mold, but continues for the others in which this height dh has not yet been detected;

f) if the height dh has not been reached in each ingot mold at the end of a dwell time determined on the basis of the time $T_0$, opening of the stopper rod by gradual increments from the initial aperture.

4.4) Catching-up phase

This phase is different for each ingot mold: it starts at different moments, but ends at the same moment $T_1$ and at the same level $N_1$ located on the curve $N=f(T)$.

This second phase comprises the following stages:

g) When the forced supply phase of an ingot mold has ended, setting in motion of level control in that ingot mold according to a level law which increases as a function of time to bring this level to a value $N_1$ determined in advance, said control acting on the position of the stopper rod of the corresponding ingot mold and this level law being linear between the point of detection and the point $N_1$, $T_1$;

h) as the height of metal dh is detected in the other ingot molds, setting in motion of level control in these ingot molds according to a level law which increases as a function of the time for each ingot mold to bring this level to the same value $N_1$ and to the same time $T_1$ as those of the other ingot molds, said control still acting on the position of the supply stopper rod of ingot molds and this level law still being linear between the point of detection and the point $N_1$, $T_1$;

The "catching-up" phase ends at the time $T_1$. In this change of phase, any delay in an ingot mold has not been taken into account, as this delay can be made good in the next phase.

4.5) Phase of following a common level law

This phase comprises one single stage:

i) starting from the time $T_1$, the control imposes on the metal level in all ingot molds the common level law $N=f(T)$. This law may have a change of gradient at $T_2$, $N_2$, or even a plurality of changes of gradient.

The third phase ends at $T_3$, $N_3$ (or $T_n$, $N_n$ if there are more than one changes of gradient in the law of levels) where the support table for the bottom blocks starts to be lowered.

4.6) Phase of lowering of the table

This phase comprises the following stages:

j) after monitoring of the levels reached and of the time lapsed, setting in motion of descent of the table supporting the bottom blocks at the time $T_3$, the theoretical level being $N_3$, application of a predetermined law of speed of descent and adjustment of the level N in each of the ingot molds according to the law $N=f(L)$, L being the length of the cast product.

A variant whose details and advantage will be explained below may consist in starting the descent of the panel as soon as the levels are all within a small interval around $N_3$ within a small interval of time before $T_3$.

k) when the programmed return length of the furnace (smaller than the length of the cast product, since the metal contained in the runner permits the casting of a further length) is reached, tilting back of the furnace or closure of the stopper rod of the furnace to stop the supply of metal, continuation of casting by virtue of the metal contained in the runner until the metal in the ingot molds is lowered to a predetermined level, raising and tilting of the portion of the runner located above the ingot molds to empty the metal still remaining in the runner through the aperture thus formed, and halting of the descent of the table.

The choice of control principle governing the metal level in the ingot mold also constitutes one of the means of the invention. It is known that there are a plurality of principles:

—control by proportional action. Displacement of the stopper rod is then simply proportional to the difference between the level of metal detected and its reference value;

—control by proportional and integral action. The displacement of the stopper rod is the sum of two terms: one proportional to the difference between the level of metal detected and its reference value, and the second proportional to the integral of the difference as a function of time;

—control by proportional, derived and integral action. Displacement of the stopper rod is the sum of three terms: the first proportional to the difference, the second proportional to the derivative of the differences as a function of time, and the third proportional to the integral of the difference as a function of time.

The Applicant has found that the most suitable system for the application in question is the second, by proportional and integral action. It is sufficiently rapid and sensitive, and avoids in particular "pumping" and instability.

The corresponding apparatus comprises:

a) means of supplying molten metal from a holding furnace, for example a tilting system or stopper rod, b) a runner for supplying the continuous casting ingot molds by means of calibrated apertures equipped with means for total or partial sealing, c) means for maintaining a constant level in the runner, comprising a system for detecting this level and a control system acting on the tilting or aperture of the stopper rod of the holding furnace, d) means for total or partial sealing of the calibrated apertures of each ingot mold, each comprising a pin known as a stopper rod and an actuator for this pin capable of finding automatically the closing point of the aperture, e) metal level sensors installed above each ingot mold, f) a control system governing the metal level in each ingot mold, first at a determined law of increase particular to this ingot mold and then at a law of increase common to all the ingot molds by control of the actuator acting on the section of the supply aperture of the ingot mold, g) a system for detecting that a determined level $N_3$ has been reached in all the ingot molds and controlling the descent of the table supporting the bottom blocks sealing the bottom of the ingot molds at start-up according to a predetermined law of speed, h) a system for detecting that the programmed return length of the furnace has been reached and controlling halting of the supply to the runner from the casting furnace, halting of the descent of the panel, and raising and tilting of the portion of the runner located above the ingot molds.

The detailed description of the process and apparatus will become clearer from the Figures, in which:

FIG. 1 shows, as indicated above, the principle of the continuous casting of semi-finished goods as practised in the prior art.

FIG. 2*a* and its variant 2*b* show the metal level control system used in the invention.

FIGS. 3*a* and 3*b*, taken together, constitute a flow chart of successive stages of a continuous casting operation according to the invention.

Figure 1:
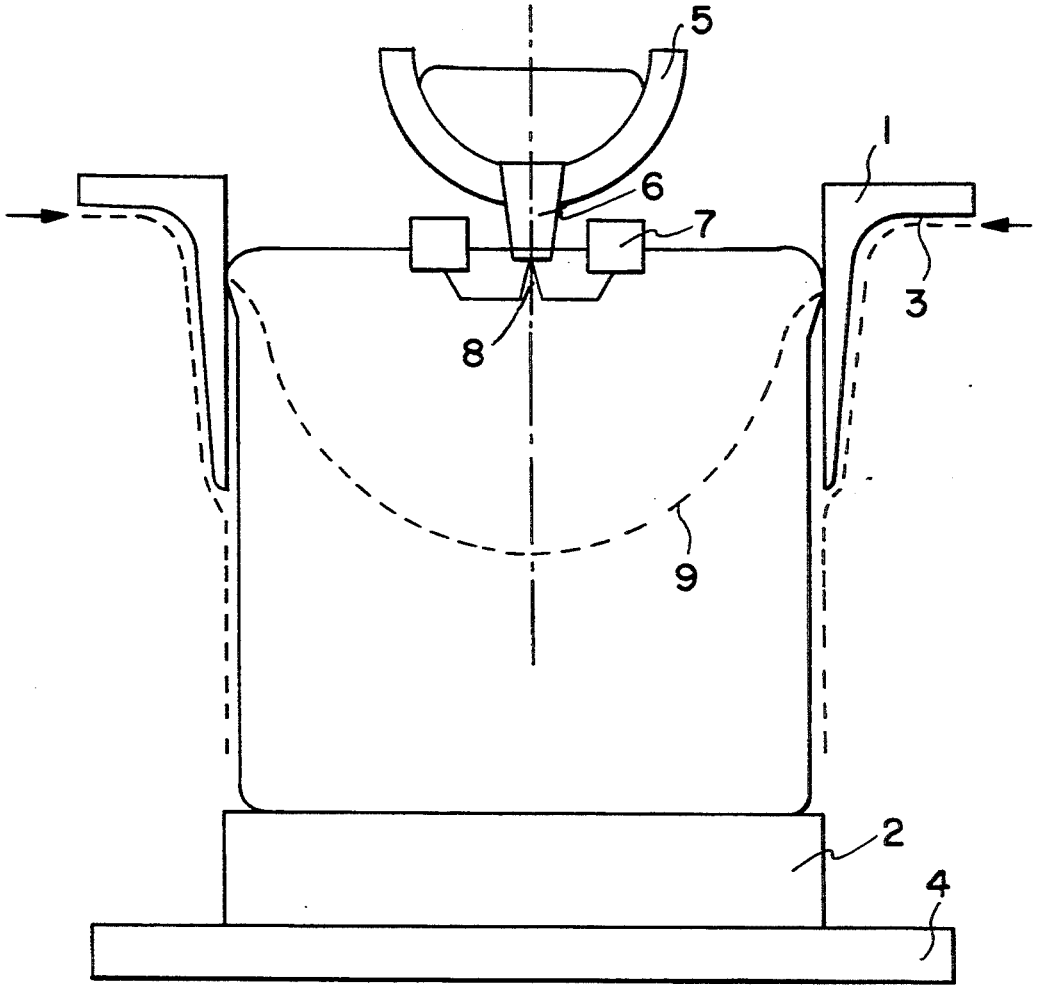
FIG. 1 PRIOR ART
Figure 2A:
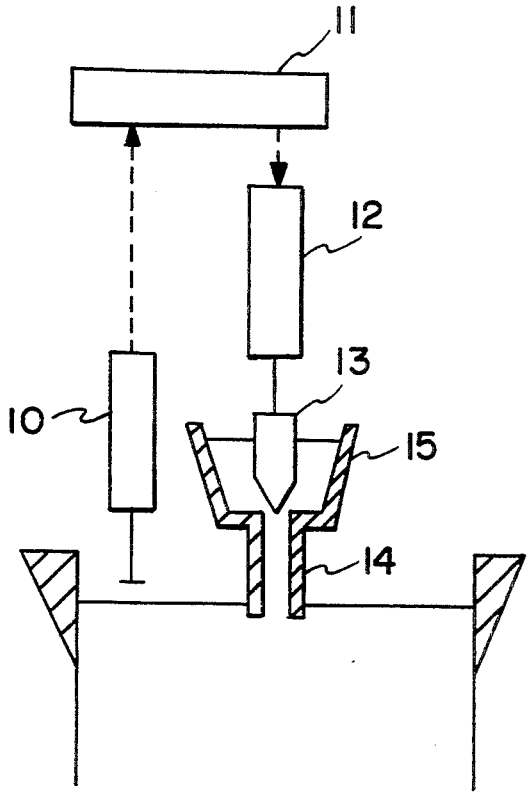
Figure 2B:
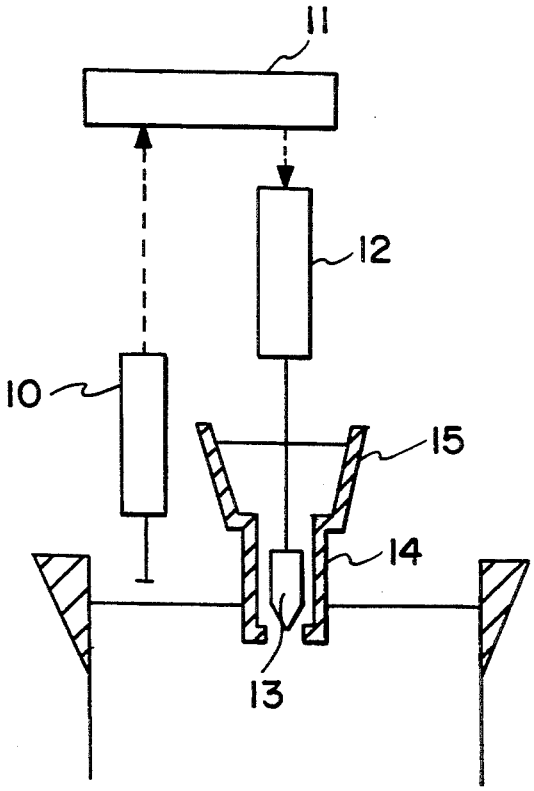
Figure 10:
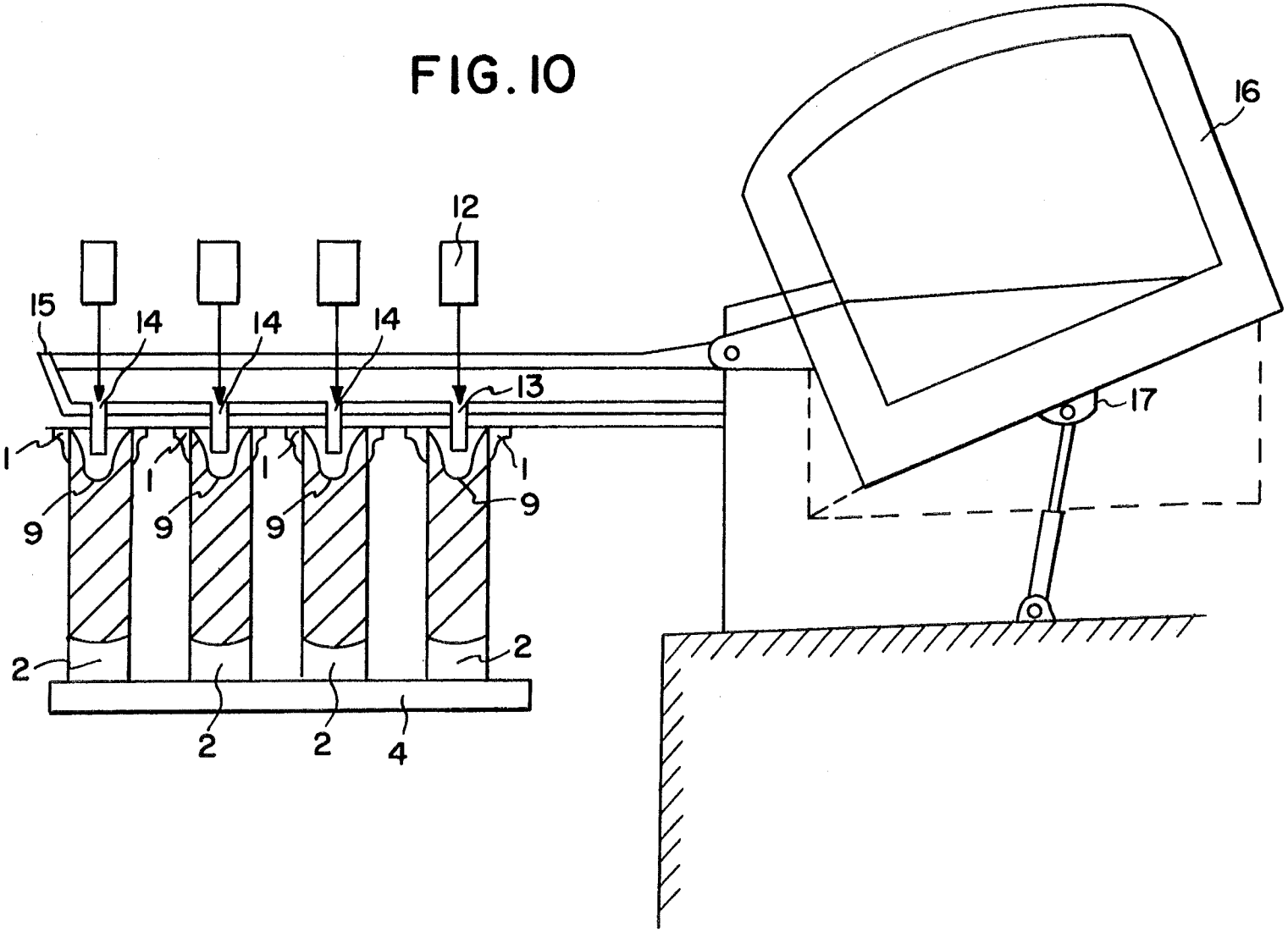
FIG. 10 shows a side view of the apparatus of the invention including a plurality of molds and a casting furnace.

In FIGS. 2*a*, 2*b* and 10 it can be seen that the metal level control system comprises:

—a level sensor (10) which releases a signal proportional to the metal level in the ingot mold, —a regulator (11) which compares this signal to a reference value representing the desired level, —an actuator (12) for displacing vertically the stopper rod (13) as a function of the difference detected by the regulator, —a stopper rod (13), whose generally frustoconical lower part seals to a greater or lesser extent the upper section of the nozzle (14) according to its position, thus acting on the flow of molten metal coming from the runner (15).

Metal is supplied to runner 15 from a casting furnace 16 which is tilted by tilting means 17. The runner supplies a plurality of ingot molds, each including a metal level control system.

The stopper rod (13), instead of sealing the upper section of the nozzle, may, by way of modification, seal its lower section. Such an arrangement is shown in the attached FIG. 2*b*.

In this case, it is not possible to fill the runner with the nozzles closed, because the metal then sets between the nozzle and the stopper rod. The procedure used is therefore the variant described above:

Before casting:

—the stopper rods are preset to non-zero aperture (the so-called initial position, or if necessary, over-aperture)

—a dam located just upstream of the first nozzle is closed;

The runner is filled to a threshold level;

The dam is opened and the origin of times of the common level law is launched;

Filling is continued as in the general case.

Figure 3A:
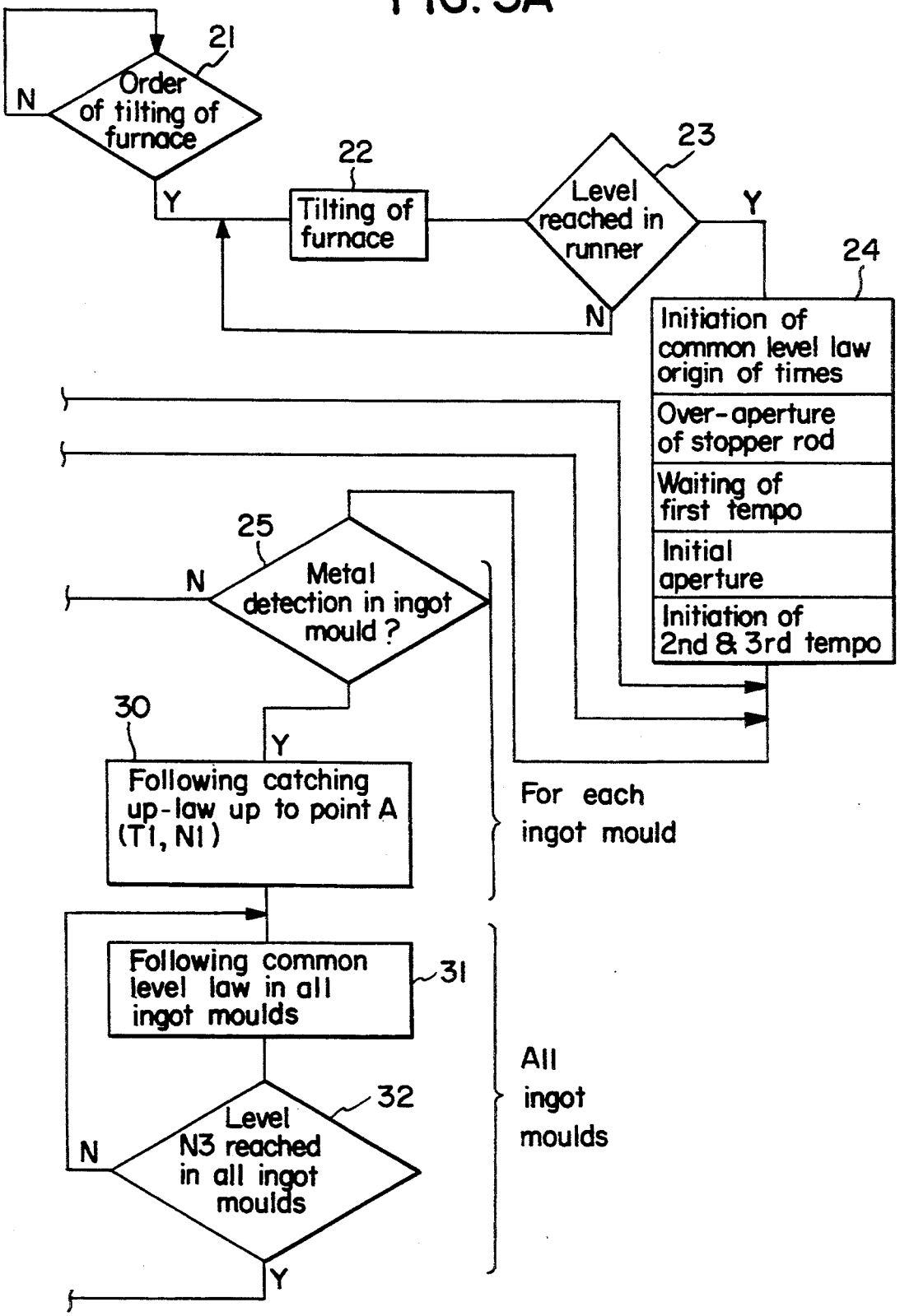
Figure 3B:
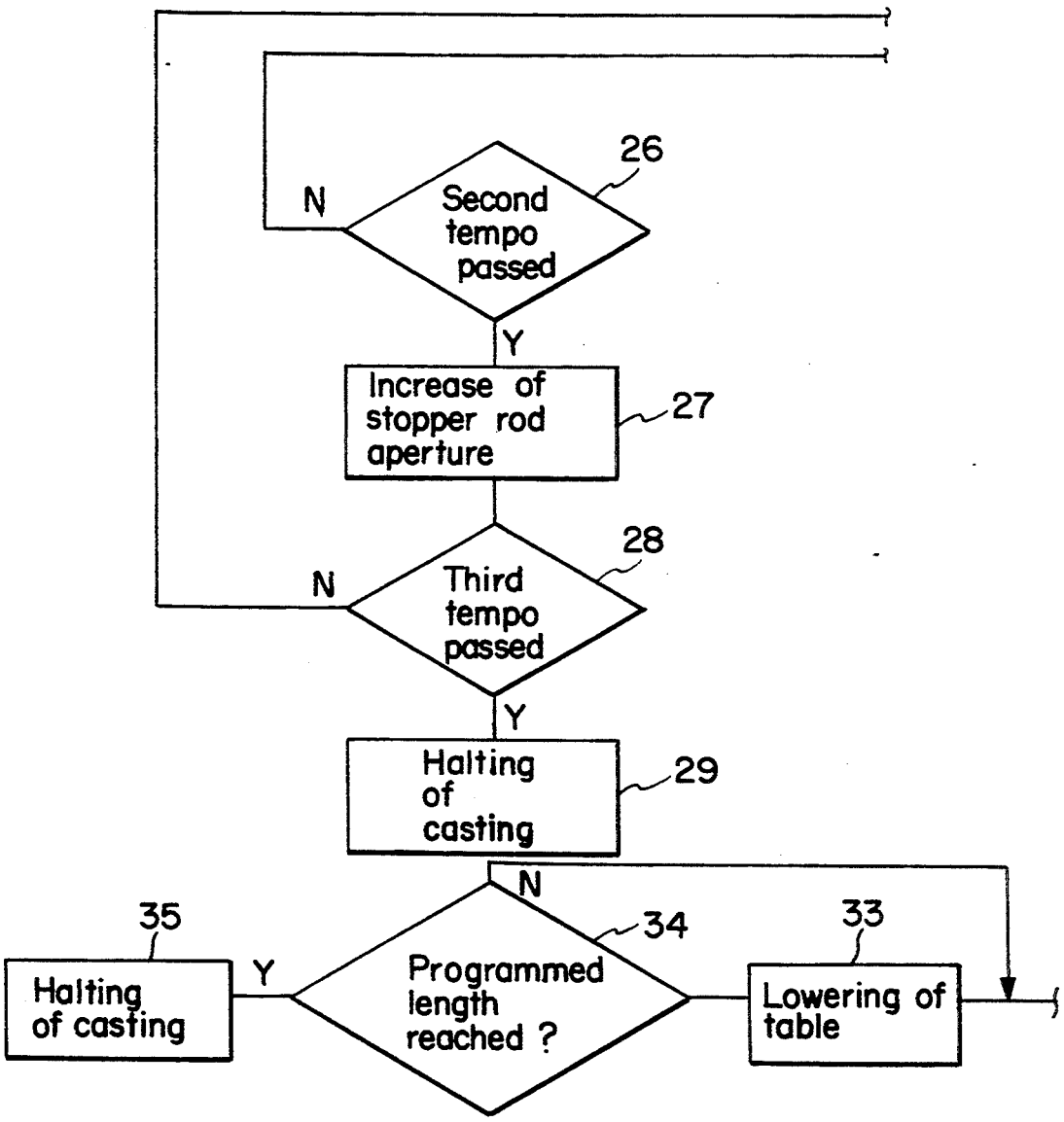

In the flow chart shown as FIGS. 3*a* and 3*b*, taken together, in a conventional manner, the successive stages of the process (excluding the preliminary phase) are shown with rectangles, and the stages having an alternative function of realising (Y for yes) or not realising (N for no) an external condition are shown with lozenges. The text inside the rectangle indicates the operation in question; the text inside the lozenge formulates the external condition.

The first lozenge (21) in the upper part of the diagram shows the order of tilting of the furnace. If this is not given (N), the program loops back on itself. If it is given (Y), one passes to the next stage: tilting of the furnace (22). The molten metal flows into the runner and, with the stopper rods for supplying the ingot molds closed, the level of metal rises in the runner. The level sensor located in the runner constantly compares the actual level with a reference level (23). If this level is not reached (N), the furnace continues to be tilted. As soon as the level is reached, the next stage is initiated: (24).

Figure 4:
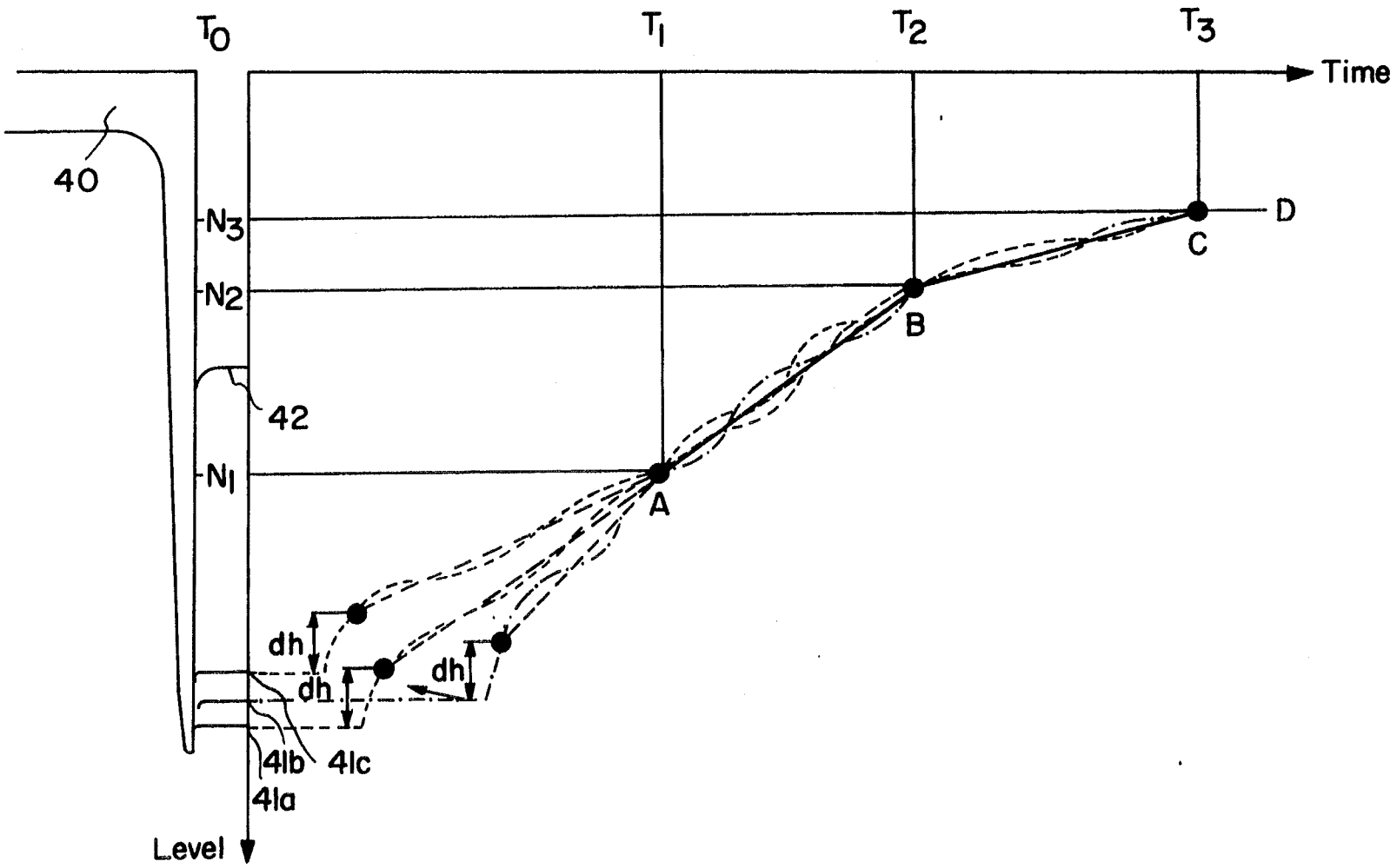
FIG. 4 shows, as a function of time and with a solid line, an example of a level law set in the ingot molds and the actual levels reached in the different ingot molds, of which there are three in the present example.

The supply stopper rods of the ingot molds all open to a position such that the flow of molten metal is sufficient to prevent untimely solidification. At this moment, the origin of the times of the law of variation of the metal level in the ingot mold, common to all ingot molds, is released. Such a law is shown in FIG. 4 and will be commented on below. Then, after a very short predetermined time, the stopper rods all close partially to a fixed initial aperture. It is also possible, as was indicated above, to pass directly to the initial aperture without preliminary over-aperture.

From this stage on, the successive operations follow on independently for each ingot mold. The diagram only shows the sequence of stages for one single ingot mold, but it is the same for each of the others.

The lozenge (25) shows the comparison in the height of the metal above the false bottom detected in the ingot mold with a predetermined reference value dh, 3 mm for example. If this height dh is not reached after a set period of time (26), a law of aperture of the stopper rod by increments which are a function of time (27) is then initiated so as to accelerate filling of the ingot molds to the reference value. If, in any one of the ingot molds, in spite of the successive increments in aperture of the stopper rod, the reference height is not reached after a specified period (28), this indicates that some incident has taken place, and casting is then halted (29).

In a normal case (25, Y) the molten metal will have reached the reference height dh, but not at the same moment in each ingot mold. Then all the ingot molds have to be brought to the same moment, and to the same level corresponding to the law of levels as a function of time. To this end, the program calculates for each individual ingot mold a particular law of catching-up starting from the point of detection and permitting the metal levels in each ingot mold to link up with the law of levels at the point A ($T_1$, $N_1$) of FIG. 4, for example (rectangle 30).

From this point A in FIG. 4, the law of level as a function of time is common to all the ingot molds and is shown in FIG. 4 itself (31).

At (32) the level sensors of the ingot molds compare the metal level detected with a reference level $N_3$ allocated for lowering of the table supporting the bottom blocks. If this level is reached, the table is lowered (33).

The next stage consists in comparing the length of the product cast with the programmed length (34). If this length is reached, casting is halted (35). Halting of casting involves the following consecutive operations, which are not shown in the flow chart:

—tilting back of the furnace or closure of its casting stopper rod in order to halt the supply of molten metal, —continuation of casting with the metal contained in the runner until the metal level in the ingot molds has decreased by a specified amount, —raising and tilting of the portion of the runner located above the ingot molds, and halting of the descent of the table.

FIG. 4 shows, as a function of time, the metal level located relative to the ingot mold for a continuous casting plant comprising, for the sake of simplicity, three outflows a, b, c only. But the description applies in the same way to a plant comprising a higher number of outflows.

For greater clarity, FIG. 4 shows a half-ingot mold (40) in section next to the vertical axis of the levels, the bottom blocks in the initial position (41, a, b, c) of the three ingot molds, and a level of metal at a given moment (42). The law of levels set, which depends on the alloy and the format, is shown by the solid line A, B, C, D. The height dh is the minimum height detected at the stage (25) of FIG. 2. It is established that the height dh has been reached consecutively by the metal in the ingot molds c, a and b. The program then calculates three laws of linear levels with different gradients (shown by hyphens) according to the "delay" of the ingot molds and the position of the bottom block at the start and on which the individual control of each of the ingot molds will converge, so that the metal levels are identical at the point A. Then, from A to B, then B to C, the individual adjustments of each of the ingot molds impose on all the levels, with the fluctuations inherent in any adjustment, the common law anticipated up to the level $N_3$, which governs lowering of the panel. The levels actually observed are shown with dotted lines. The descent is thus triggered by the simultaneous fulfillment of two conditions:

—$T > T3$

—for any ingot mold n, $N_n = N_3$.

In practice, and due to the fluctuations inherent in any adjustment, the second condition may lead to the total interruption of supply to the most advanced ingot mold for a relatively long time. This is contrary to the second principle mentioned above and may lead to defects in the foot of the cast product.

Figure 5:
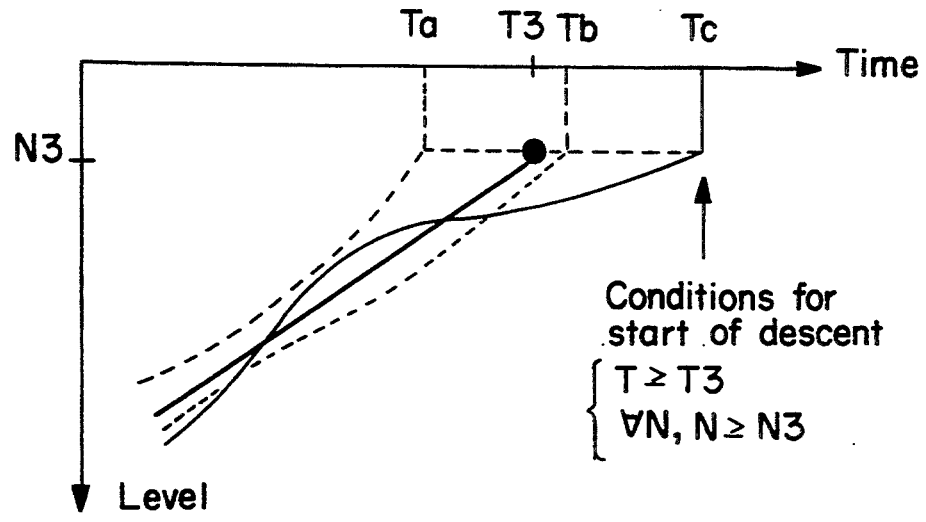
FIGS. 5, 6 and 7 show the position of the metal levels at the moment when lowering of the table is set in motion relative to the reference value and the three modifications of conditions to be met for triggering this setting in motion.

This situation is illustrated diagrammatically in FIG. 5, which shows in a system of time-level axes the law of levels with a thick, solid line, and with a dotted line the progress of the levels observed in all ingot molds, the number of which is limited to three (a, b, c) in this example. The ingot mold has reached the level $N_3$ at the time $T_a$, the ingot mold b at the time $T_b$, and the ingot mold c at the time $T_c$. Lowering of the panel does not begin therefore until the time $T_c$. The ingot mold a remains unsupplied for a relatively long time $T_c - T_a$, the ingot mold b for slightly less long. This wait is prejudicial to the quality of the products, however.

Figure 6:
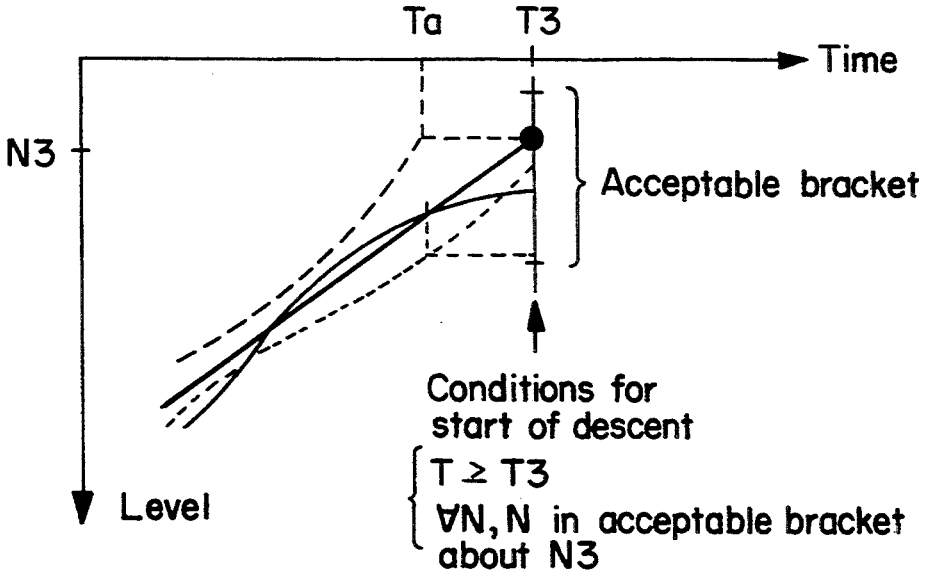
Figure 7:
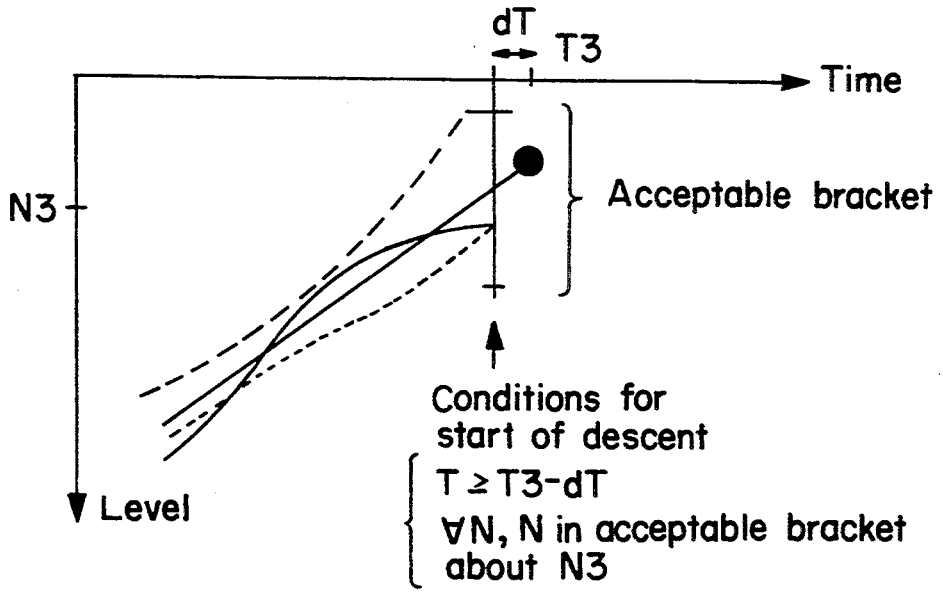

In addition, two conceivable variants have been shown diagrammatically in FIGS. 6 and 7 respectively.

These two figures are identical to FIG. 5. They show the same law of levels and the same progression of the levels observed in the three ingot molds a, b, c.

In the variant in FIG. 6, at the time $T_3$, only the ingot mold a has reached the level $N_3$; its supply has been cut since the time $T_a$. Thus the levels reached at the time $T_3$ in the two other ingot molds are compared with the reference level $N_3$. If the levels $N_b$ and $N_c$ are in an acceptable predetermined bracket, symmetrically or otherwise, about $N_3$, lowering of the table is started.

This variant has the advantage of considerably limiting the period during which the ingot mold a, which is the most advanced, ceases to be supplied.

The conditions for the start of lowering of the panel become:

—$T > T3$

—for any ingot mold n, $N_n$ within an acceptable bracket about $N_3$.

In the variant shown in FIG. 7, comparison of the levels $N_b$ and $N_c$ with $N_3$ is carried out not only from the moment $T_3$, but from a predetermined time interval dT before $T_3$. Since, from the time $T_3 - dT$, all levels in the three ingot molds are within the level bracket specified, lowering is initiated.

The conditions for the start of lowering become:

—$T > T3 - dT$

—for any ingot mold n, $N_n$, in an acceptable bracket about $N_3$.

The functioning of the invention just described implies:

—precise and reliable measurements of the level

—precise positioning means for each of the stopper rods relative to each of the nozzles.

According to the invention, the following are preferably used:

—a capacitive sensor for the metal level,

—an actuator incorporating a device for detecting the point of closure of the nozzle.

The principle of the capacitive sensor is the following:

A plane capacitor is formed, of which one electrode is a metal disc and the other the upper surface of the molten metal. It is known that the capacitance of a plane capacitor C is equal to the product of the surface of the electrode and the dielectric constant of the medium separating the electrodes, divided by the distance between the electrodes. The measure of the capacitance of the capacitor is an indirect measurement of the distance between the two electrodes and therefore of the level of the metal.

Figure 8:
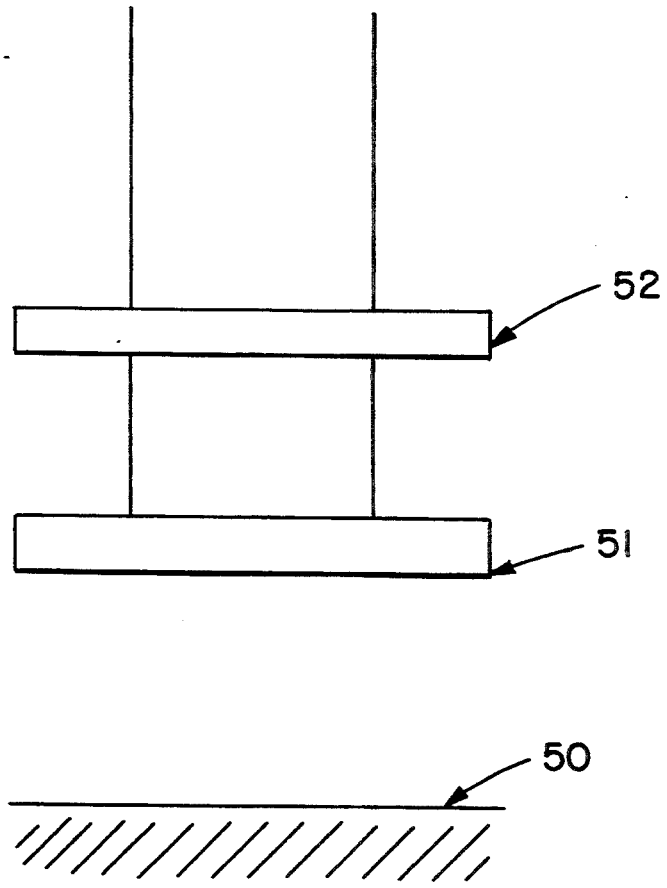
FIG. 8 shows a preferred embodiment of a capacitive level sensor.
Figure 9:
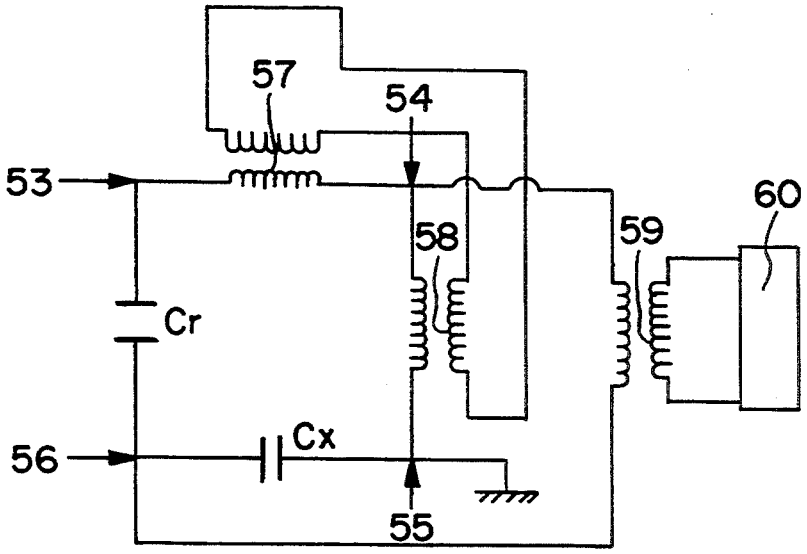
FIG. 9 shows a diagram of the measuring bridge used for measuring the level.

In practice, the operation is carried out roughly as follows, as is shown in FIGS. 8 and 9.

FIG. 8 shows the probe itself located above the upper surface of the molten metal in an ingot mold.

FIG. 9 shows the diagram of the bridge for measuring the capacitance of the capacitor thus formed.

In FIG. 8, the level of molten metal, indicated by the reference (50), forms one of the capacitor electrodes. The second electrode (51) forms part of the probe proper. A third electrode (52), located at a fixed distance above the electrode (51), forms therewith a second capacitor, whose capacitance will act as a reference in the measuring bridge to be discussed below. By way of example, the distance e between the level of molten metal and the electrode (51) is 18 mm at equilibrium, the same as the distance between the two electrodes (51) and (52).

The capacitance of the capacitor $C_x$ formed by the electrodes (50) and (51) is constantly compared to the reference capacitance $C_r$ of the capacitor formed by the electrodes (51) and (52) by means of a measuring bridge, which is shown diagrammatically in FIG. 9. The bridge comprises 4 branches interconnected by 4 nodes (53), (54), (55), (56). The branches (53)–(54) and (54)–(55) are supplied with alternating sinusoidal current via two identical transformers (57) and (58), whose primaries are connected in series to a high-frequency current source (80 khz, for example). In the branch (55)–(56), the capacitor $C_x$ is placed, and in the branch (56)–(53), the reference capacitor $C_r$. The node (55) corresponding to the electrode formed by the molten metal of $C_x$ is connected to earth. This is easily realised via the metal table supporting the bottom block on which the cast product rests. The opposite nodes (54) and (56) are connected together via a transformer (59) to a current sensor (60). When the distance between the electrodes (50) and (51) of $C_x$ is equal to a reference value, 18 mm for example, the capacitances of $C_x$ and $C_r$ are equal, the bridge is balanced and no current passes through the sensor (60). When this distance decreases or increases, the bridge is unbalanced and a current passes through the sensor. An electronic system then sends a command to a servomotor which raises or lowers the probe so as to bring it to a distance from the molten metal equal to the reference value of 18 mm for example. By repeating the successive displacements of the probe, it is possible to generate at any moment a signal corresponding to the level of molten metal in the ingot mold.

Such a device is located above the molten metal in each ingot mold and permits measurement and control of the level of metal.

The actuator is essentially characterised by its device for detecting the point of closure of the nozzle. According to the invention, the actuator is preferably formed mainly of an electric back-geared motor unit with precise automatic control of the position of the rod. The rod is hollow and comprises inside a shaft capable of sliding several millimetres. This shaft is held extended by a spring-type device. The stopper rod is fixed to this shaft.

When the rod moves in the withdrawal direction, if the stopper rod meets an obstacle in its path, the spring is pushed in, the shaft sides into the rod and actuates a stroke limit.

With this sensor device, it is possible to determine by an automatic procedure the point of closure of the nozzles. This point corresponds to the position of minimum withdrawal of the rod, permitting the actuation of a stroke limit, corrected by the stroke effected by the shaft to push in the spring and actuate the stroke limit.

The opening position of the stopper rod is then determined from this reference point.

5) EXAMPLE

The device described above was mounted on a continuous casting unit intended for the simultaneous casting of 5 plates with the format 1360 mm by 610 mm in aluminum alloy 5052 (Aluminum Association Standard). The ingot molds are arranged parallel to one another and transverse to the axis of the supply runner. Their height is 115 mm. The reference value for dh is 3 mm above the double-curved bottom block. The reference value for $N_3$ is 48 mm below the upper level of the ingot mold. The speed of descent is 42 mm/minute. These parameters were fed into the automation system.

A first command initiated the preliminary stage of finding the points of closure. According to the outflows, these points are found to be located between 18 and 29 mm of the stroke of the actuators, which is 100 mm (0 mm=rod completely withdrawn). At the end of this stage, the actuators have placed the stopper rods at their point of closure.

A second command started casting proper. At the end of the stage of filling the runner, as soon as a threshold level was reached, the stopper rods opened 7 mm above the point of closure. The first ingot mold to reach the height dh reached it 18 seconds after the opening of the stopper rods, the last 25 seconds after this opening.

All ingot molds reached the level $N_1$ at the reference time $T_1=40$ s, by following the individual reference laws.

The level $N_3$ was reached by all the ingot molds 85 seconds after opening of the stopper rods, the moment at which the support table for the bottom blocks began its descent.

I claim:

1. A process for continuous casting of plates or billets of aluminum alloy from a casting furnace through a runner equipped with nozzles into a plurality of water-cooled ingot molds, each of said molds closed at a lower end by a bottom block and supported by a common table which moves vertically during casting, comprising the steps of:

a) causing a stopper rod in each of said nozzles to be prepositioned at a point of closure for said nozzles;

b) supplying liquid aluminum to the runner by tilting the casting furnace or by opening a casting hole in the casting furnace, the liquid aluminum filling the runner to a predetermined level;

c) when the liquid aluminum fills the runner to said predetermined level, at a time $T_0$, moving said stopper rods to a point corresponding to a predetermined initial aperture value, causing liquid aluminum to flow into the ingot molds;

d) as a predetermined metal height above the bottom block dH is detected in each mold, automatically and individually adjusting the position of the stopper rod of the nozzle corresponding to said mold and thus adjusting the flow of aluminum so as to reach a predetermined metal common metal level $N_1$ in all molds at a common time $T_1$, variation of the aluminum level N in each mold being linear as a function of time between the level corresponding to dH and the level $N_1$;

e) at $(T_1,N_1)$, imposing a common level function $N=f(T)$ on all molds, until reaching a reference level $N_3$ at time $T_3$, then lowering the table at a predetermined speed, the level N being, after the time $T_3$, a function of the length of cast product; and f) when the cast product reaches a predetermined length, stopping the supply of aluminum to the runner, casting the aluminum remaining in the runner and stopping the lowering of the table.

2. A process for continuous casting of plates or billets of aluminum alloy from a casting furnace through a runner equipped with nozzles into a plurality of water-cooled ingot molds, each of said molds closed at a lower end by a bottom block and supported by a common table which moves vertically during casting, comprising the steps of:

a) causing a stopper rod in each of said nozzles to be prepositioned at a point defining a predetermined initial aperture for said nozzles;

b) supplying liquid aluminum to the runner by tilting the casting furnace or by opening a casting hole in the casting furnace, the liquid aluminum filling the runner to a predetermined level;

c) providing a dam located just upstream of the most upstream of said nozzles;

d) when the liquid aluminum fills the runner to said predetermined level, at a time $T_0$, removing said dam and causing liquid aluminum to flow into the ingot molds;

e) as a predetermined metal height above the bottom block dH is detected in each mold, automatically and individually adjusting the position of the stopper rod of the nozzle corresponding to said mold and thus adjusting the flow of aluminum so as to reach a predetermined common level $N_1$ in all molds at a common time $T_1$, variation of the aluminum level N in each mold being linear as a function of time between the level corresponding to dH and the level $N_1$;

f) at $(T_1,N_1)$, imposing a common level function $N=f(T)$ on all molds, until reaching a reference level $N_3$ at time $T_3$, then lowering the table at a predetermined speed, the level N being, after the time $T_3$, a function of the length of cast product; and g) when the cast product reaches a predetermined length, stopping the supply of aluminum to the runner, casting the metal remaining in the runner and stopping the lowering of the table.

3. A process according to claim 1, wherein if height dH is not detected in one of said ingot molds after a specific dwell time starting at $T_0$, then the stopper rod of the nozzle corresponding to said ingot mold is moved in gradual increments to increase the flow of liquid aluminum into said ingot mold.

4. A process according to claim 1 or 2, wherein during said flow of liquid aluminum following time $T_0$, said stopper rods are moved to increase said aperture value for a period of time, and then moved to restore said initial aperture value, in order to insure high metal flux and avoid freezing.

5. A process according to claim 1 or 2, wherein said lowering of the table starts when $T>T_3$ and when the level N for any ingot mold is within a predetermined deviation from $N_3$.

6. A process according to claim 1 or 2, wherein said lowering of the table starts when $T>T_3-dT$, where dT is a predetermined time interval, and when the level N for any ingot mold is with a predetermined deviation from $N_3$.

7. A process according to claim 1 or 2, wherein adjustments of the aluminum level in the ingot molds are controlled by proportional and integral action.

8. In an apparatus for continuous casting of metal from a casting furnace through a runner equipped with nozzles into a plurality of water-cooled ingot molds, each of said molds closed at a lower end and supported by a common table which can be moved vertically, where a flow of metal is obtained either by tilting the casting furnace, or by opening a casting hole closed by a stopper rod, and is controlled in each nozzle by a stopper rod closing the nozzle, the improvement comprising:

a) means for maintaining a constant level of metal in the runner, comprising means for detecting the metal level and means for controlling the tilting of the furnace or the position of the stopper rod closing the casting hole;

b) means for activating the stopper rod of each nozzle, allowing partial or total closing of the nozzle;

c) a metal level sensor installed above each ingot mold which generates a signal proportional to the increase in metal level in the mold;

d) means for individually controlling the metal level in each ingot mold according to a predetermined level function, by moving the stopper rod of the nozzle corresponding to the ingot mold;

e) means for detecting that a predetermined metal level has been reached in all ingot molds, and controlling descent of the table according to a predetermined speed function; and f) means for detecting that a predetermined length of cast product has been obtained and subsequently stopping descent of the table, closing the nozzles by actuating the stopper rod of each nozzle, and stopping the supply of metal from the casting furnace to the runner.

9. Apparatus according to claim 8, wherein the metal level sensor is a capacitive level probe comprising:

a) a plane capacitor having a first electrode which is the surface of the metal in the ingot mold and a second electrode which is a plate parallel to the surface at a predetermined distance therefrom;

b) a measuring bridge for comparing the capacitance of the plane capacitor to a fixed reference capacitor;

c) a servomotor automatically controlled by the measuring bridge and capable of displacing the second electrode upwards or downwards to maintain the capacitance of the plane capacitor constant; and d) means for generating a signal proportional to the displacement of the second electrode.

* * * * *

UNITED STATES PATENT AND TRADEMARK OFFICE

CERTIFICATE OF CORRECTION

PATENT NO. : 5,409,054

DATED : April 25, 1995

INVENTOR(S) : JACQUES MORICEAU

It is certified that error appears in the above-identified patent and that said Letters Patent is hereby corrected as shown below:

Title page, item

[73] Assignee:

Change "Aluminium Pechiney; Pechiney Rhenald" to

--Aluminium Pechiney; Pechiney Rhenalu--

Signed and Sealed this

Twelfth Day of September, 1995

*Attest:*

Bruce Lehman

BRUCE LEHMAN

*Attesting Officer*

*Commissioner of Patents and Trademarks*